US007052170B2

(12) United States Patent
Striebel

(10) Patent No.: US 7,052,170 B2
(45) Date of Patent: May 30, 2006

(54) SUPER BRIGHT LED UTILITY AND EMERGENCY LIGHT

(76) Inventor: Roman F. Striebel, c/o Suncor Stainless, Inc., 70 Armstrong Rd., Plymouth, MA (US) 02360

( * ) Notice: Subject to any disclaimer, the term of this patent is extended or adjusted under 35 U.S.C. 154(b) by 181 days.

(21) Appl. No.: 10/755,516

(22) Filed: Jan. 12, 2004

(65) Prior Publication Data

US 2004/0141318 A1 Jul. 22, 2004

Related U.S. Application Data

(63) Continuation-in-part of application No. 09/968,560, filed on Oct. 1, 2001, now Pat. No. 6,676,278.

(60) Provisional application No. 60/237,012, filed on Sep. 29, 2000.

(51) Int. Cl.
*H01R 33/00* (2006.01)

(52) U.S. Cl. ..... 362/640; 362/652; 362/267

(58) Field of Classification Search ..... 362/640, 362/645, 647, 652, 648, 267, 158, 249, 365, 362/364, 362, 800
See application file for complete search history.

(56) References Cited

U.S. PATENT DOCUMENTS

| | | | | |
|---|---|---|---|---|
| 4,152,624 | A | 5/1979 | Knaebel | 313/499 |
| 4,190,976 | A | 3/1980 | Hurt | 43/17.5 |
| 4,574,337 | A | 3/1986 | Poppenheimer | 362/267 |
| 4,597,033 | A * | 6/1986 | Meggs et al. | 362/183 |
| 4,744,014 | A | 5/1988 | Harris | 362/145 |
| 4,758,934 | A | 7/1988 | von Kohorn | 362/145 |
| 5,036,442 | A | 7/1991 | Brown | 362/102 |
| 5,045,981 | A * | 9/1991 | Nagano | 362/219 |
| 5,068,773 | A | 11/1991 | Toth | 362/386 |
| 5,083,192 | A | 1/1992 | Rzeznik et al. | 357/74 |
| 5,130,909 | A | 7/1992 | Gross | 362/153 |
| 5,211,469 | A | 5/1993 | Matthias et al. | 362/101 |
| 5,222,799 | A | 6/1993 | Sears et al. | 362/146 |
| 5,264,997 | A | 11/1993 | Hutchisson | 362/226 |
| 5,450,299 | A * | 9/1995 | Lepre | 362/145 |
| 5,632,551 | A | 5/1997 | Roney et al. | 362/249 |
| 5,771,617 | A | 6/1998 | Baker | 40/544 |
| 5,779,228 | A * | 7/1998 | Hansen | 362/146 |
| 5,829,865 | A * | 11/1998 | Ahroni | 362/657 |
| 5,842,779 | A | 12/1998 | Siebert | 362/309 |
| 5,876,109 | A | 3/1999 | Scalco | 362/104 |
| 5,927,845 | A | 7/1999 | Gustafson et al. | 362/152 |
| 6,135,621 | A * | 10/2000 | Bach et al. | 362/399 |
| 6,415,732 | B1 * | 7/2002 | Delorenzo | 362/477 |

* cited by examiner

*Primary Examiner*—Ali Alavi
*Assistant Examiner*—Bao Q. Truong
(74) *Attorney, Agent, or Firm*—Burns & Levinson LLP; Jacob N. Erlich; John A. Hamilton

(57) ABSTRACT

Lighting system mountable on a surface and including one or more miniature light sources and a multi-part housing including recesses for accepting the light sources and an electrical supply line. The light sources can include light emitting diodes. Separate parts of the housing are mated in a manner to fix the position of the electrical supply line between them, and may be formed with a recess that receives an asymmetrically shaped electrical supply line in only one possible orientation. Similarly, the recesses receiving the light sources may be shaped such that electrical connections with proper polarity are assured. Either or both parts of the housing may be fastened to the surface with adhesives and/or optional holes for receiving pins, nails, screws, bolts or the like. The lighting system is particularly suitable for emergency, railing, landscape and vehicle illumination applications, and may be powered by batteries and renewable energy sources.

25 Claims, 21 Drawing Sheets

SUPER BRIGHT LED UTILITY AND EMERGENCY LIGHT

CROSS REFERENCE TO RELATED PATENT APPLICATIONS

This application is a continuation-in-part of U.S. patent application Ser. No. 09/968,560 entitled "Super Bright LED Utility And Emergency Light", filed Oct. 1, 2001, now U.S. Pat. No. 6,676,278, which claims priority of U.S. Provisional Application Ser. No. 60/237,012 entitled "Super Bright LED Utility And Emergency Light", filed Sep. 29, 2000, all of the above being incorporated herein by reference.

FIELD OF THE INVENTION

The present invention relates generally to electrical lighting and, more particularly, to easily installed recessed lighting for use with railings and similar structures.

BACKGROUND OF THE INVENTION

Miniature illumination lighting devices have historically used incandescent or halogen bulbs. These types of lighting systems are relatively inefficient. A substantial amount of energy is lost generating heat as a byproduct. Another disadvantage of these types of systems is the relatively short life span of the lighting bulbs. Consequently, these lighting systems result in high operational and maintenance costs. The problems associated with past miniature illumination systems have largely been solved by illumination devices of the type disclosed in commonly-assigned U.S. patent application Ser. No. 09/968,560, entitled "Super Bright LED Utility And Emergency Light."

There remain problems relating to the costs and adaptability of light emitting diodes (LED's) to electricity supply lines in structures such as, for example, new and existing railing systems.

Therefore, a need exists for a versatile, adaptable, inexpensive lighting system employing miniature light sources, such as, for example, LED's that is easy to install in such systems. The present invention provides such a system, that additionally enables replacement of the light sources without undue expense or effort.

SUMMARY OF THE INVENTION

The present invention provides a lighting system which is durable, inexpensive and yet versatile. The lighting system includes miniature light assemblies located within light housings. Uses for the lighting system include illumination in pleasure or commercial marine applications, in residential and commercial building applications such as emergency lighting and railings, in landscaping applications such as gardens, walkways and driveways, in vehicle applications, and in corrosive industrial environment applications such as mining.

The lighting system is described in several non-limiting embodiments below as particularly useful in railing systems such as, for example, deck railing. The lighting system allows quick, easy connection between miniature light source such as, for example, light emitting diodes (LEDs) electric supply lines, especially those such as encountered in new and existing deck railing applications. That is to say, the present invention provides in a preferred embodiment a lighting system that is easy to install by contractors or homeowners, essentially maintenance free, and that uses small, energy efficient and recessed light sources (e.g., LEDs) in an aesthetically pleasing manner (i.e., with no exposed electric wires or wire-to-wire connections.)

In one preferred embodiment, these and other objectives are achieved by a plurality of LED lights mounted in suitable recesses inside a mounting bar. Each LED is contained in a light housing that has two prongs protruding from its back, one of which is positive and the other negative. The light housing is shaped in such a way as to allow it to be inserted into the mounting bar recess in only one possible way, thus ensuring that the positive prong and the negative prong are always in exactly the same position.

The mounting bar has a lengthwise notch or groove for mateably receiving a specially shaped supply housing designed in such a way as to firmly hold an electrical supply line. A preferred, commercially available supply line is comprised of one positive and one negative lead each surrounded by differently-shaped flexible molded plastic segments; one segment rounded and the other square so as to identify the positive and the negative leads. The supply housing includes a lengthwise recess shaped to accept the asymmetric supply line in only one possible orientation, thus ensuring that the positive lead and negative are always arranged in the same position. This allows the supply line to be aligned with the prongs of the light source(s), so as to maintain proper polarity. The light source prongs are designed to penetrate the outer plastic of the supply line to connect directly to the positive and negative leads within.

Both the mounting bar and the supply housing have bores or through-holes disposed through their widths to allow fastening to any surface through any conventional fastening means (e.g., screws, bolts, nails, etc.) The mated mounting bar and supply housing create a nearly seamless and water-tight assembly for conveying electrical power to a plurality of recessed, miniature light sources. In a preferred embodiment, the mated mounting bar/supply housing assembly also serves as a support for a handrail, in which a groove or channel may be formed to receive the assembly. The assembly may also be received by other rail structures, such as rail posts, at each end.

Each miniature light assembly preferably, but not necessarily, comprises an LED light source as described in commonly assigned and co-pending patent application Ser. No. 09/968,560 entitled "Super Bright LED Utility and Emergency Light", the contents of which are incorporated herein by reference. In such light assemblies, the negative prong incorporates an insulated wire directly connected to the light source, while the positive prong incorporates an insulated wire connected to the light source by a resistor. In each light assembly, sealant is disposed within the light housing affixing the relevant position of the positive and negative prongs and the light source. The sealant prevents any water or moisture from reaching the electrical connections of the light assembly. The light housing is shaped so as to surround and protect the light source without allowing the sealant to reach or coat the light source.

In another embodiment, the lighting system is additionally equipped with a power source, and means for controlling the operation of the power source, such as, but not limited to, photocells, timers and/or switches.

The present invention uses of only one continuous electric supply line, and LED connections are made to that supply line by pushing the LED into its specially shaped recess, and thus forcing the prongs to puncture the plastic coating of the electric supply line and make a direct connection. This eliminates significant electrical work, usually required with standard lights having two leads protruding from them and therefore requiring individual electric connections to those. The use of uniform orientation of the supply line throughout the supply housing ensures that the same supply line from the power source can be used throughout the installation. The supply line can be easily twisted through holes in posts, plates, stanchions or similar supports, but regardless of such contortions will still be aligned properly in the supply housing with respect to the lights source prong/leads. This is especially important with LEDs, which function only with proper polarity.

The use of one electrical supply line in the supply housing provides the maximum flexibility to mount LED lights anywhere along the housing, and also allows differently shaped mounting bars to be used to conform with the design of the structure (e.g., railing system) within which it is employed. This allows use in both new and existing retrofit railing systems, regardless of the construction of those railing systems, and further permits use of the present invention for many other applications not mentioned herein, provided the supply housing bar and a mounting bar can be mounted to a surface of a structure.

BRIEF DESCRIPTION OF THE FIGURES OF THE DRAWINGS

For a better understanding of the present invention, together with other and further aspects thereof, reference is made to the accompanying drawing and detailed description, wherein.

DETAILED DESCRIPTION OF PREFERRED EMBODIMENTS OF THE INVENTION

Figure 1:
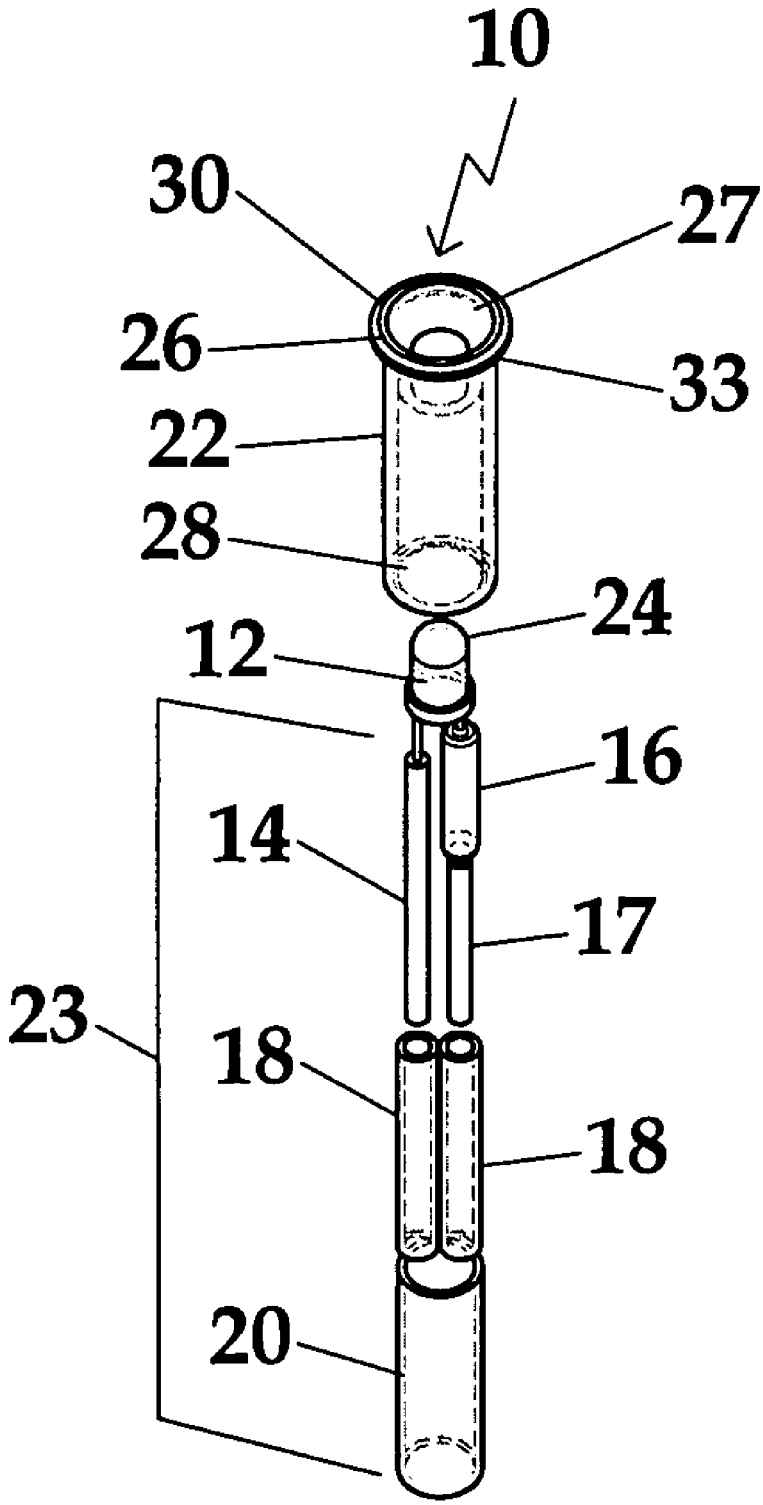
FIG. 1 is an exploded pictorial view of a miniature lighting assembly of the present invention.
Figure 2:
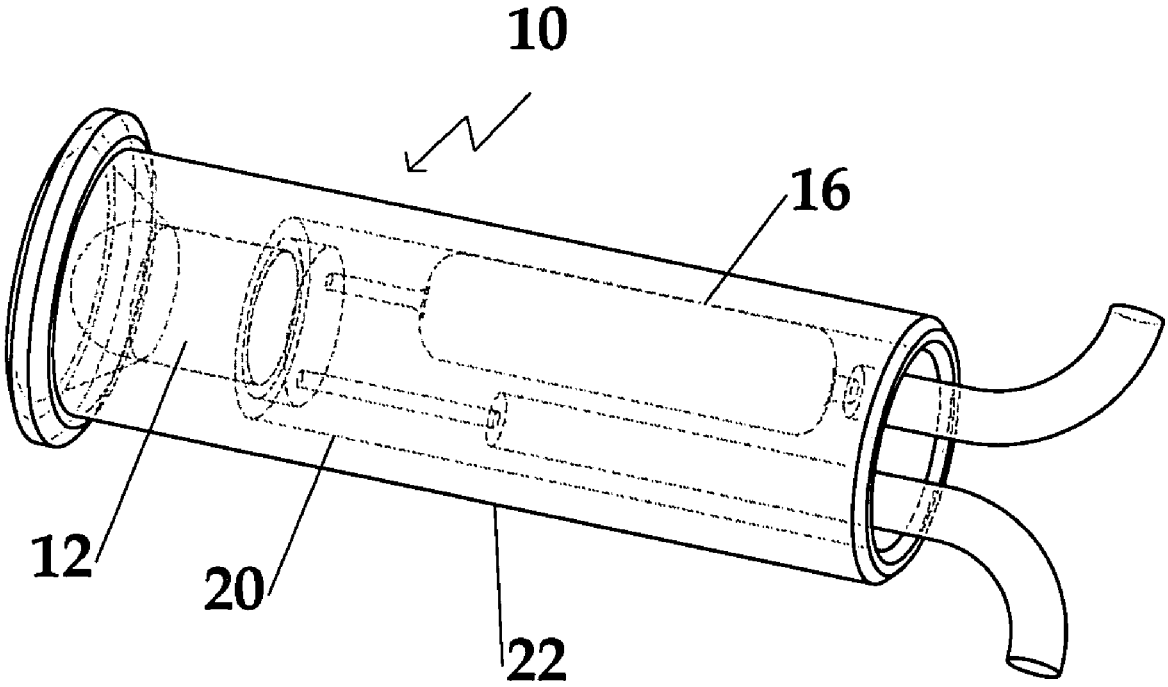
FIG. 2 is a pictorial side view of a miniature lighting assembly.

With reference to FIGS. 1 and 2, a non-limiting example of miniature light assemblies 10 used in the inventive lighting bar system of the present invention includes a bright white LED 12, an electric insulated wire having a negative lead 14 connected to the LED 12, a resistor 16 connected to the LED 12, and an electric insulated wire having a positive lead 17 connected to the resistor 16. The term "wire" as used herein refers to a conductive material having sufficient strength and rigidity to puncture the plastic coatings found on conventional electrical supply lines. The portion of the wires protruding from the housing are referred to below as 'prongs', and they may include tapered or beveled ends to facilitate the puncturing of the electrical supply line coatings. The resulting LED connections may be covered by a small, inner piece of shrink-tube 18 after which the complete component assembly 23 is covered by an outer shrink-tube 20, which all together prevent any electrical component from touching housing 22, preferably composed of stainless steel or another sturdy material.

The electrical component assembly 23 is then inserted into the housing 22. As shown in FIG. 1, one embodiment of the housing 22 comprises of a top portion 26, which includes a flat area 30, an inside chamfered surface 27 and a housing shoulder 33, and a bottom portion 28. The housing 22 is stepped in such a way that only the dome 24 of the LED fits through the top portion of the housing 26 and the electrical component assembly 23 is contained in the bottom portion of the housing 28. Once inside the housing 22, the assembly 23 may be surrounded with a commercially available sealant such as epoxy or silicon sealer to prevent any water or moisture from reaching the resistor 16 or connections, but without the sealant being able to reach or coat the LED 12 lens. Furthermore, the housing 22 is machined so that the top portion of the housing 26 surrounds and protects the LED 12 against damage. Additionally, when using a metal housing 22, the inside chamfered surface 27 and the flat area 30 are polished after machining so as to enhance the reflective light of the LED 12. The finished lighting assembly 10 is connected to a desired power source near the bottom portion of the housing 28 by means of the electrical wires/prongs 14, 17. Other miniature light sources, including non-LED light sources and LED light sources with different housings are deemed to be within the scope of the present invention.

Figure 3:
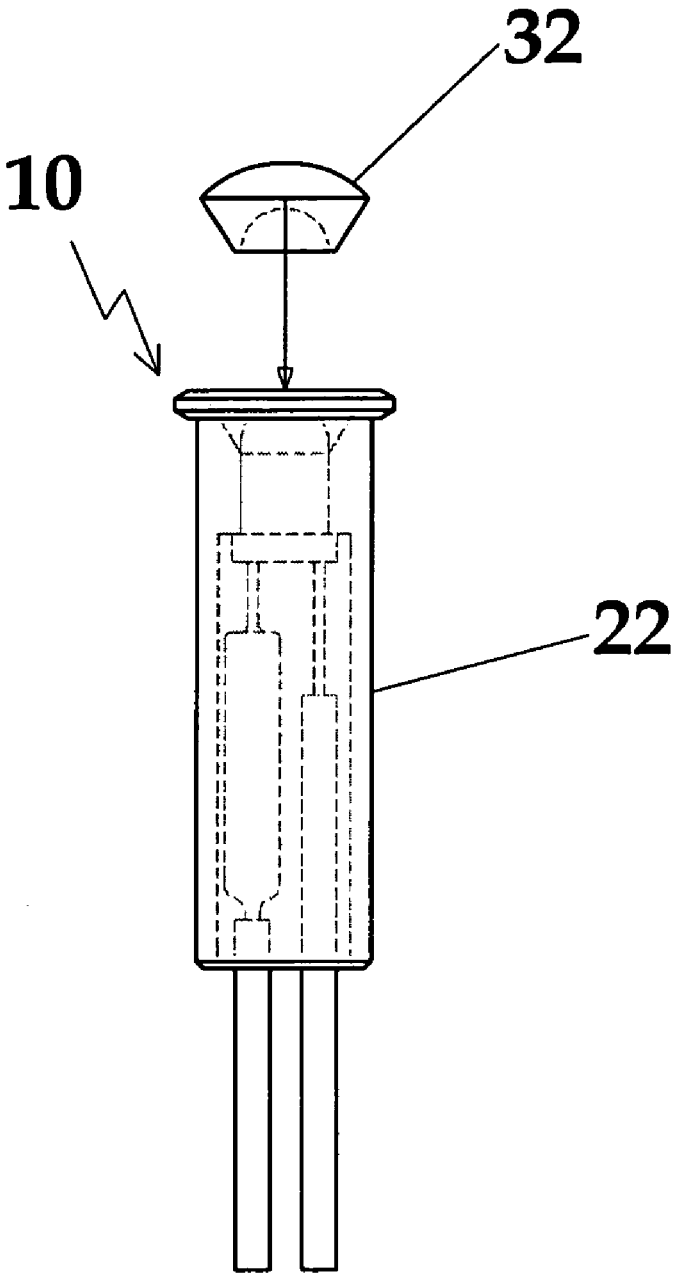
FIG. 3 is an exploded side view of the miniature lighting assembly with a cap that permits a diffused light pattern.

With reference to FIG. 3, in another embodiment of the miniature light assembly 10, a machined or injection molded cap or diffusing lens 32 is affixed to the top portion 26 of the housing 22, thus providing a "softer", diffused light source and wide-angle coverage as opposed to the point of light generated by the uncovered LED 12.

Since the lighting assemblies 10 are very small (e.g., the outside diameter of the housing 22 is on the order of ¼"), the assemblies 10 can be directly and without other parts mounted in practically any natural and synthetic material, such as wood, fiberglass, glass, metal, stone, plastics, concrete, plasterboard, and other such materials. As described in an embodiment below, the housing 22 may simply be inserted into a hole or recess formed in a mounting block. The recess in the mounting block is preferably shaped to receive the light assembly in only one orientation, thus ensuring that the positive and negative leads of the light assembly are properly positioned with respect to an electrical supply line within the mounting block. The light assembly may be secured in the recess by dimensioning the recess such that the light assembly fits snugly in the recess, or through other purely mechanical means such as, for example, grommet 42 (such as shown in FIG. 5*c*.) A sealant, such as epoxy or silicon sealer may be additionally applied to secure the light assembly in the recess, bearing in mind that the light assembly will need replacement at the end of its useful life.

The lighting bar system of the present invention, which incorporates a plurality of miniature light assemblies, is useful in emergency lighting in houses or any other buildings, and may be permanently or temporarily installed with ease. Depending on the size of the room, one or more lighting bars may be permanently mounted into the walls, preferably approximately 12" from the ceiling, or into the ceiling itself. Such installations generate a brighter light inside the room, since the ceilings reflect the bright white light of the LED 12. A small room may only require one lighting bar, whereas an average 10'×10' room may require two or three lighting bars. Corridors may require one lighting bar having miniature light assemblies 10 positioned within the bar every six to eight feet. Although the illumination provided by the miniature light assemblies 10 is probably not bright enough to permit reading in such rooms, the brightness is certainly sufficient to see all objects inside the room, find the doors, windows, beds or other features very easily. When not in use, the miniature light assemblies 10, due to the very small size of their face and being flush with the wall, are hardly noticeable and will not detract from any décor.

Figure 10:
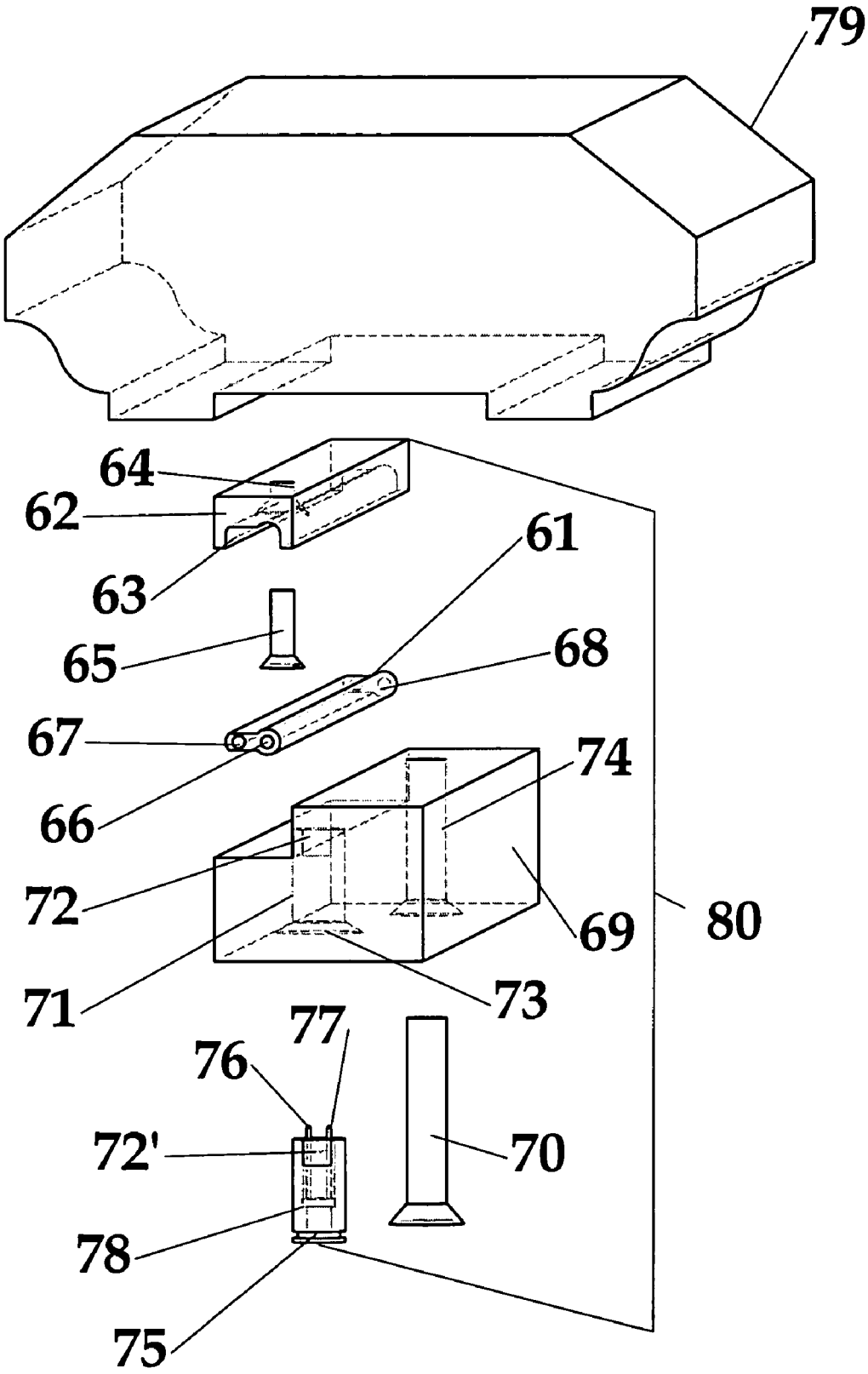
FIG. 10 is an exploded view of a lighting bar system in accordance with the present invention, illustrated in a railing embodiment.
Figure 11:
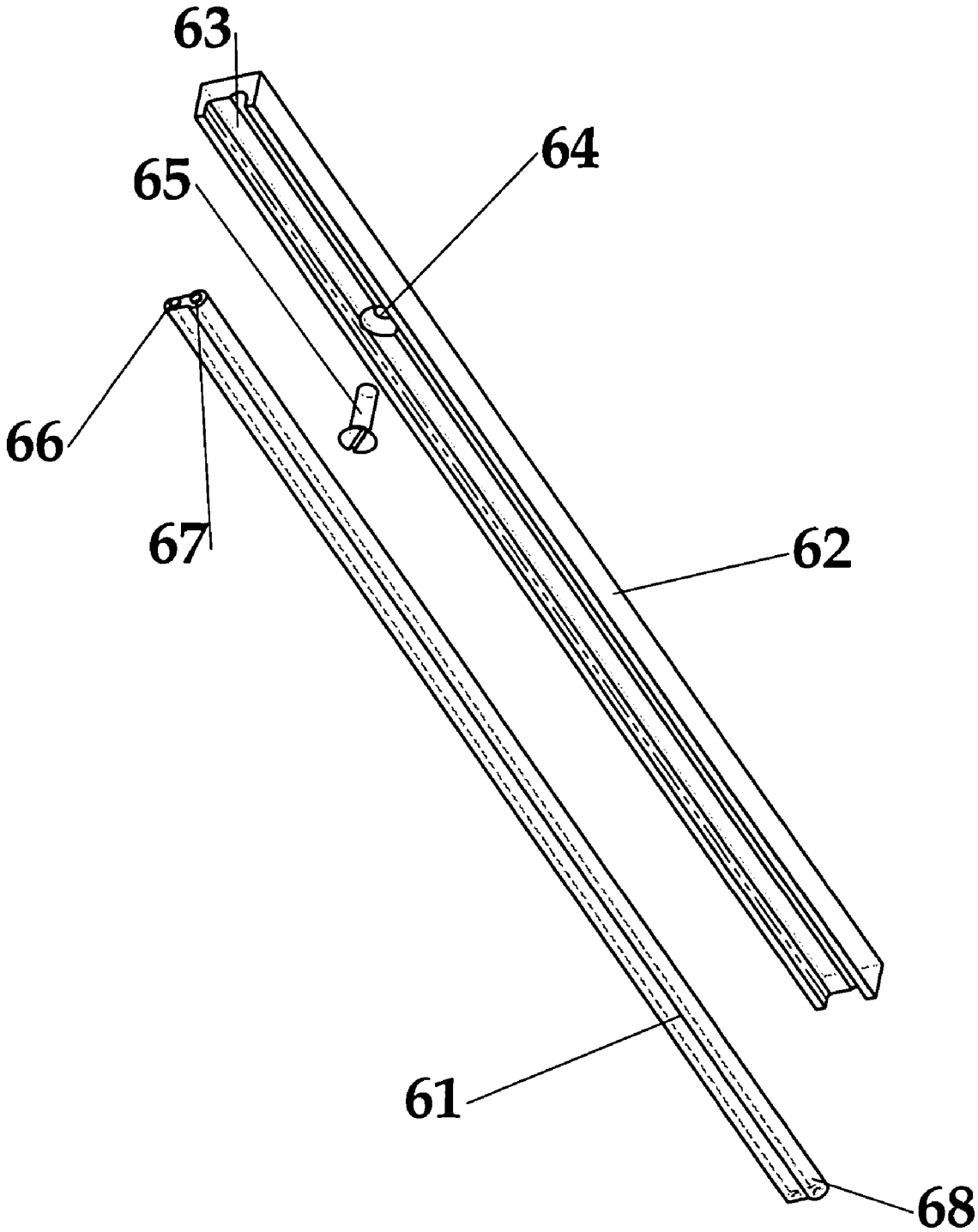
FIG. 11 is a pictorial exploded view of a supply line housing component and supply line of the lighting bar system of the present invention.
Figure 12:
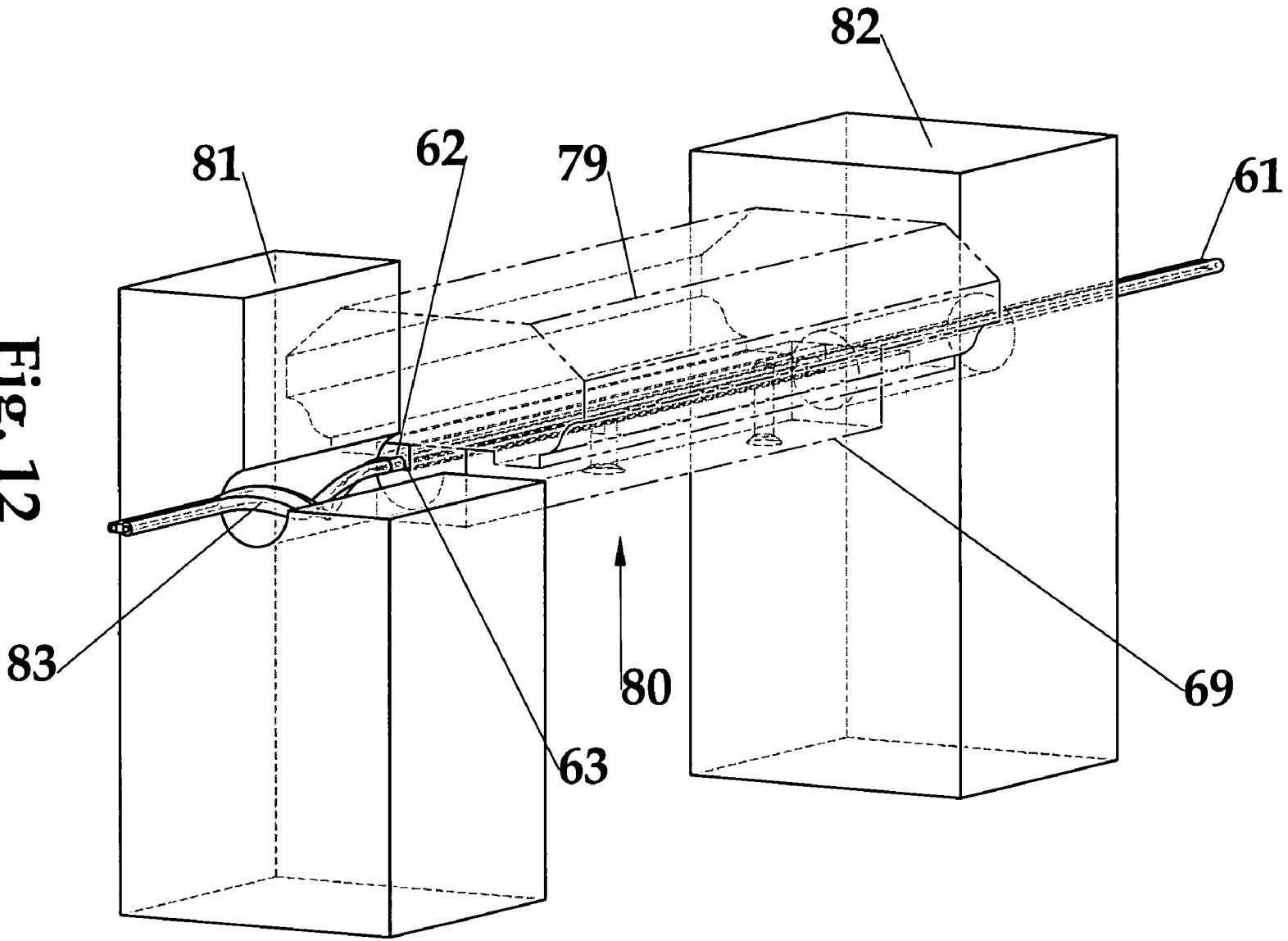
FIG. 12 is a pictorial view of the lighting bar system of the present invention in a railing environment.

Before describing in detail FIGS. 4–11 of the drawing, reference is made to the embodiment of a lighting bar 80 depicted in FIG. 12, which may be utilized in railings such as found, for example, in deck railing. Each miniature light assembly is connected to a single supply line through their positive and negative leads or prongs. For standard or emergency use, the supply line may be powered by one or more standard 12V batteries or converted wall power supply. The batteries may then be charged either by a solar charging unit thus completely avoiding any electric power supply or by a suitable, commercially available trickle charger, which keeps the batteries fully charged during the time when electricity is available, for use in electric emergencies. Since the power requirements of a LEDs are low (approximately 20 milliamps each), very little charging by solar energy is required. Consequently, lighting assemblies can provide illumination over a long period of time on a standard 12V battery without any recharging. For example, an installation of 20 LEDs, operated only at night without battery recharge, took four days to drain a standard battery and thus would provide many more hours of use than any existing emergency system, which typically lasts for only a few hours. The lighting bar system may be used to illuminate any size deck railing to provide a measure of safety and a beautiful accent to the railing itself. Lighting bars may be used for any railing whether constructed from square or round tubing, wire rope, wood, metal or other material. The light bars may be mounted under the top rail with the light sources shining downward, providing light on the rail without loss of night vision. The installations of the miniature light assemblies in rails are exceptionally easy and accomplished using simple tools such as a drill, screwdriver, saw and screws, and/or with glues and epoxies.

Another application of the lighting bars 80 is illumination for walkways using brick, natural, or concrete paving stones of any shape. In all stone applications, a masonry drill is used to form a channel for the light bar(s) and to drill one or more holes through the stone for securing the light bar. It is preferred for safety purposes that the light bar lies recessed below the surface of the stone, thus protected from any traffic. As paving is laid, light bars can be inserted into pre-cut stones and held in place by fasteners or sealants. The ends of the light bar may be sealed to protect the supply line within, and the supply line itself is then connected to a power source, which can either be activated by a switch, photo-eye or timer. In such applications, any light pattern design may be possible. The light bar can illuminate a walkway and/or surrounding landscaping, and be manufactured in straight or curved sections and/or in articulating segments to adapt to any setting.

Lighting bars 80 also have application in any marine environment. A small number of the miniature light assemblies 10 installed in a cockpit of a boat can illuminate the space or the steps down in such a way as to avoid the loss of night vision. In any cabin, one or more of the miniature light assemblies 10 can provide enough illumination to comfortably use the space such as near bunks, over galley equipment, or as spot or emergency lights in the salon. This is especially useful when attached to a rigging, where such miniature light assemblies 10 can illuminate upwards towards the sails, or downwards towards the blocks and other equipment. The exceptionally small, compact size of the light bars makes installation feasible even in applications which were not previously accommodated with standard lights.

Another application of the light bars is in illumination within and around vehicles. The light bars may be mounted into or onto the sides of truck loading beds, or the "roll bars" or compartments of vehicles. The advantages of the light bars include manufacture and adjustment of size and shape to fit an application, durability, and easy installation.

Figure 4A:
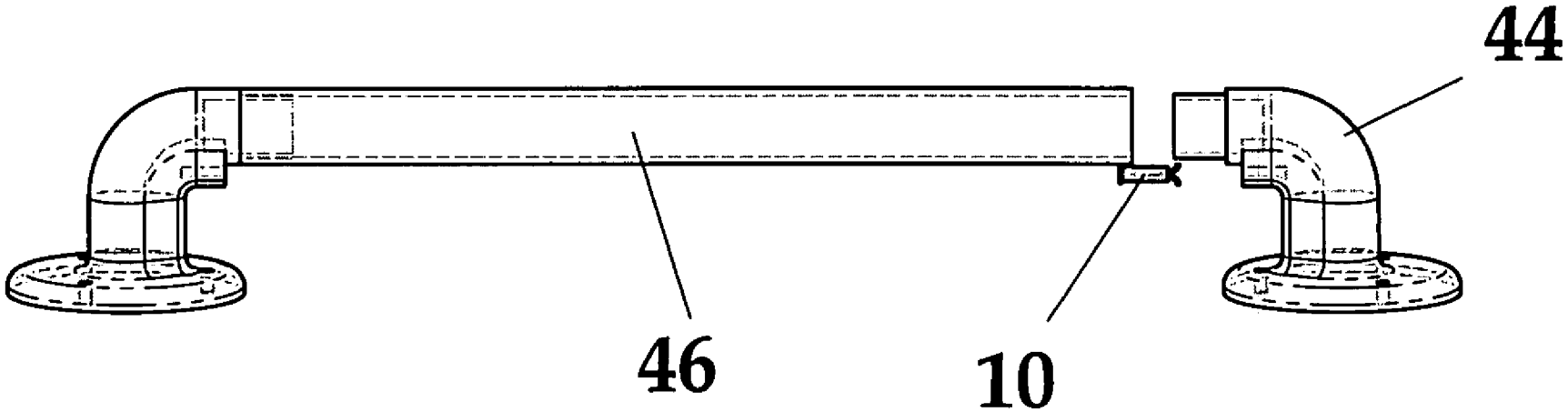
FIG. 4*a* is a pictorial view of the miniature lighting assembly mounted within a mounting base of a handrail.
Figure 4B:
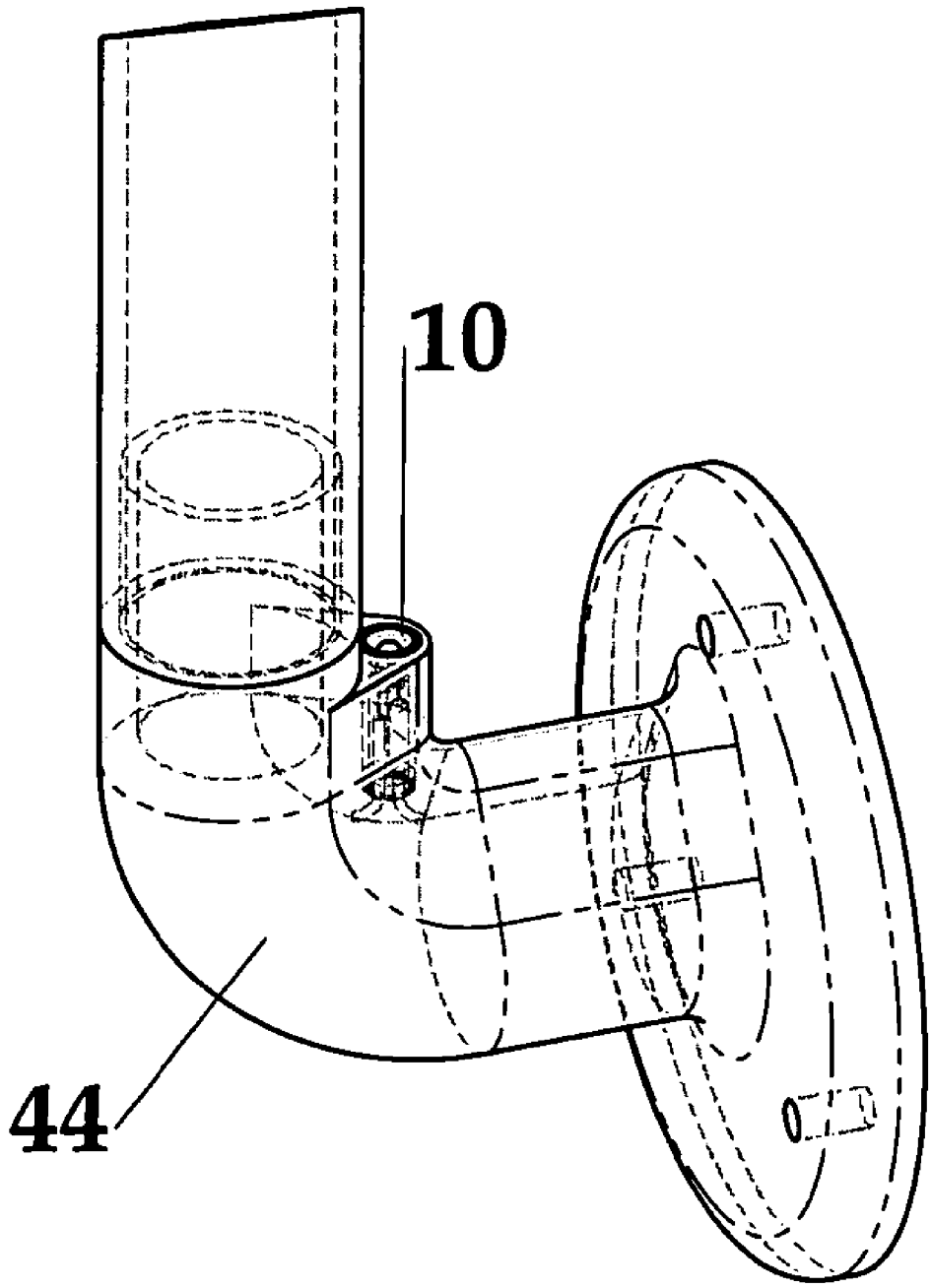
FIG. 4*b* is a partial pictorial view of the miniature lighting assembly within the mounting base of the handrail.

Referring to FIGS. 4*a,b*, the miniature light assemblies 10 may be mounted directly into a mounting base 44 on a handrail 46, thus allowing illumination of the handrail 46 without undue interference with its functionality. Potential applications include the lighting of grab bars and other handles such as those associated with ambulance, fire, construction, utility and other standard vehicles. Another advantage of the mounting base 44 is any length of rail 46 may be used as the mounting bases 44 are identical and interchangeable with various lengths of straight tubing.

Figure 5A:
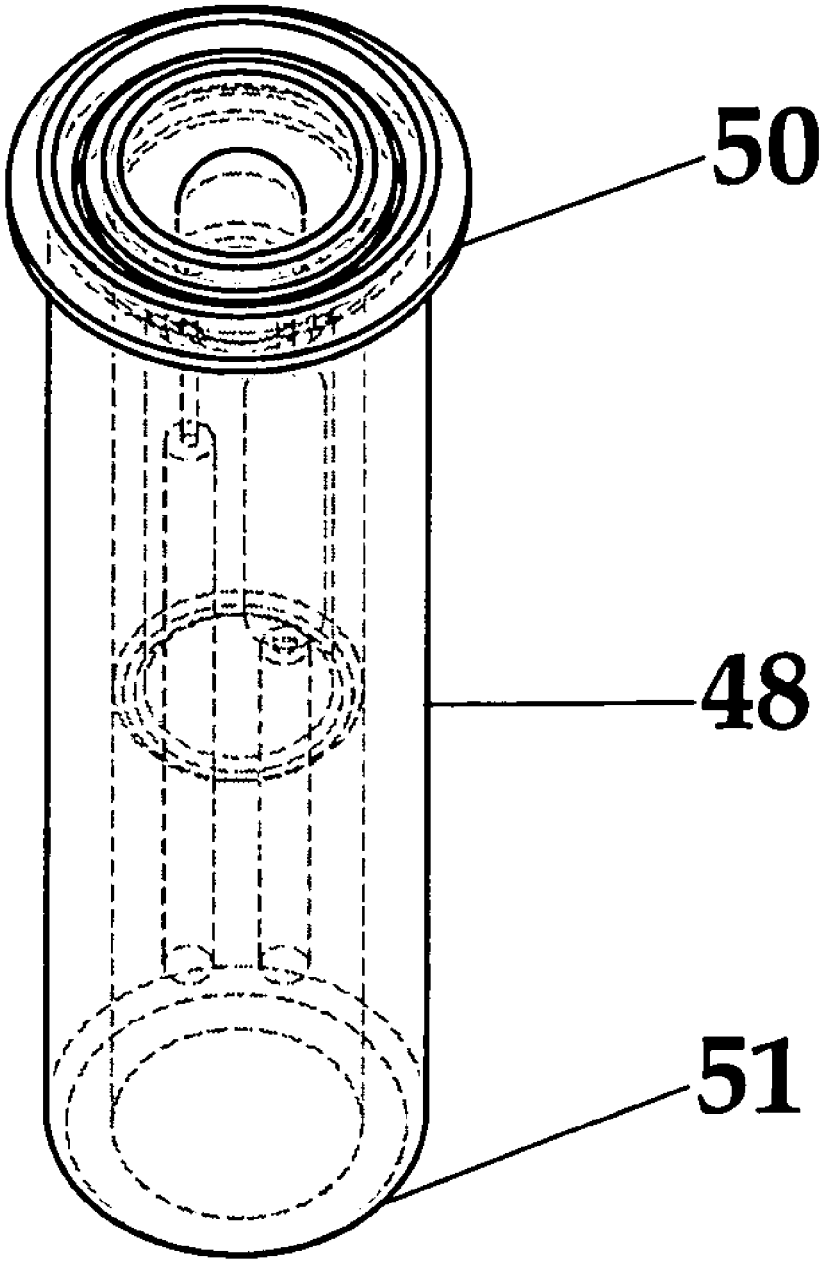
FIG. 5*a* is a pictorial view of the miniature lighting assembly flush mounted within an outer housing.
Figure 5B:
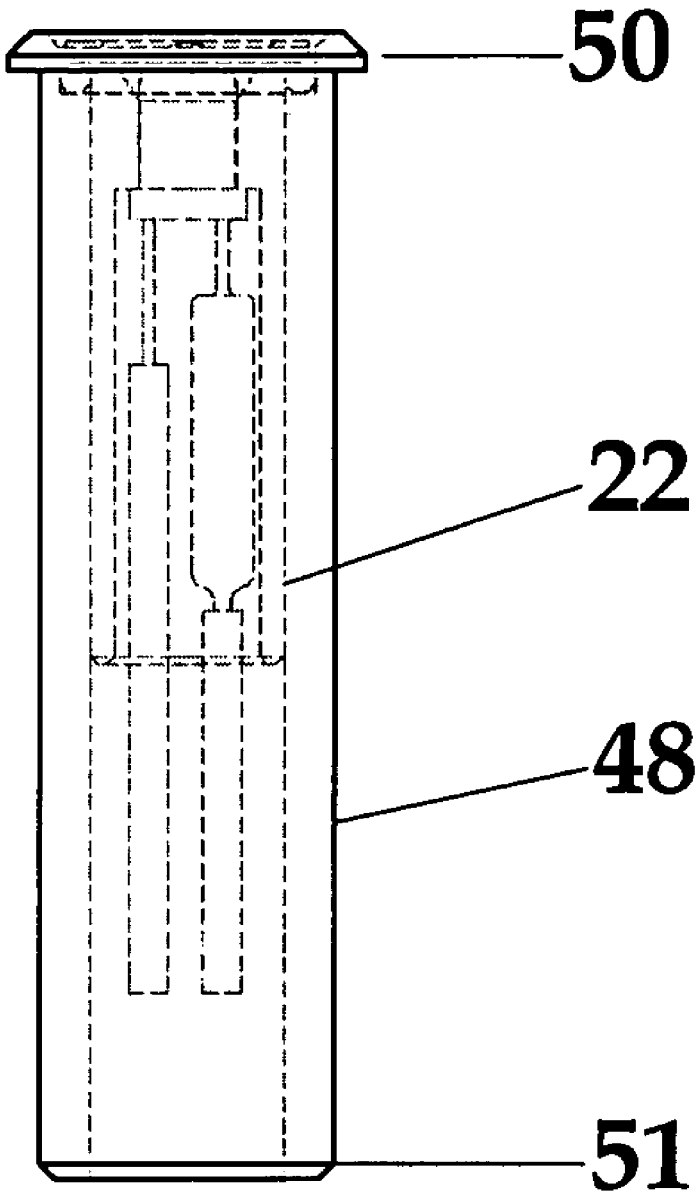
FIG. 5*b* is a side view of the miniature lighting assembly flush mounted within an outer housing.
Figure 5C:
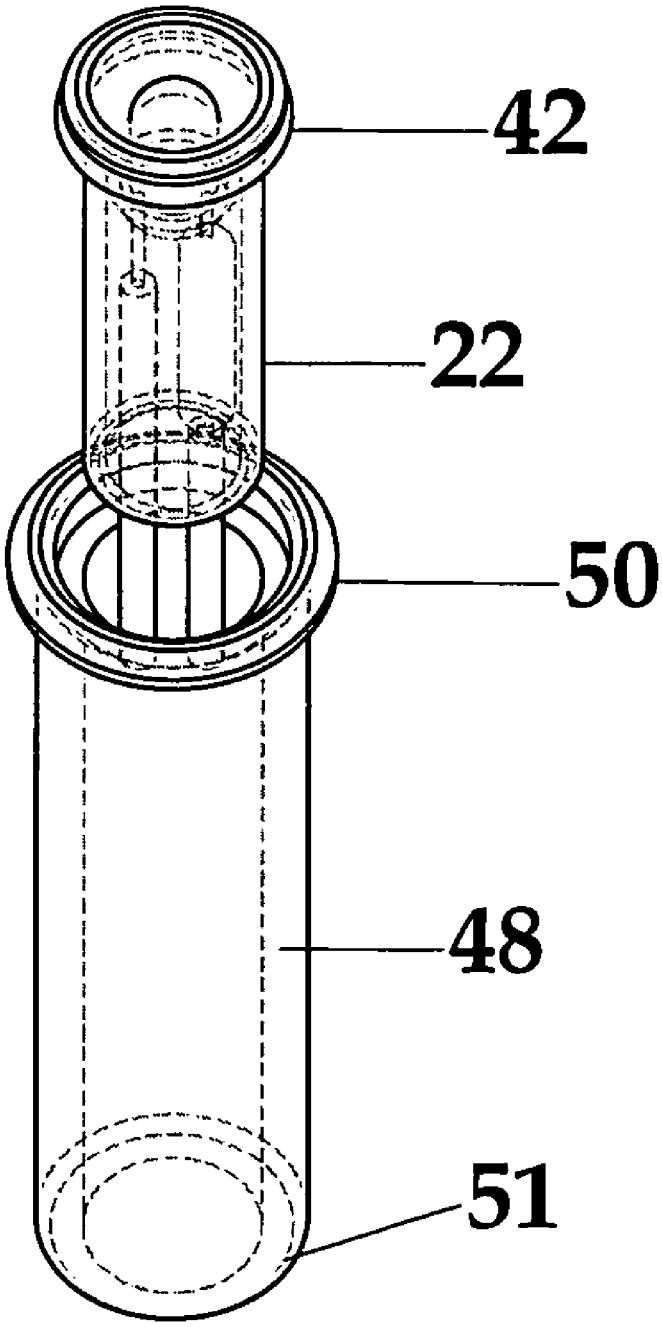
FIG. 5*c* is an exploded pictorial view of the miniature lighting assembly flush mounted within an outer housing.

Referring also to FIGS. 5*a*–*c*, the miniature light assemblies 10 may also include an outer housing 48 for applications which require the pre-positioning and casting-in of the miniature light assembly 10 as encountered in concrete, plaster, swimming pools, and many other applications requiring cast or poured material. The outer housing 48 consists of a top portion 50 where the housing 22 is inserted, and a bottom portion 51 which is connected to a flexible or rigid conduit before being cast into the surrounding material. Such an arrangement allows all lights to be installed at any time. The outer housing 48 may be made from any material, but preferably stainless steel or plastic.

Figure 6A:
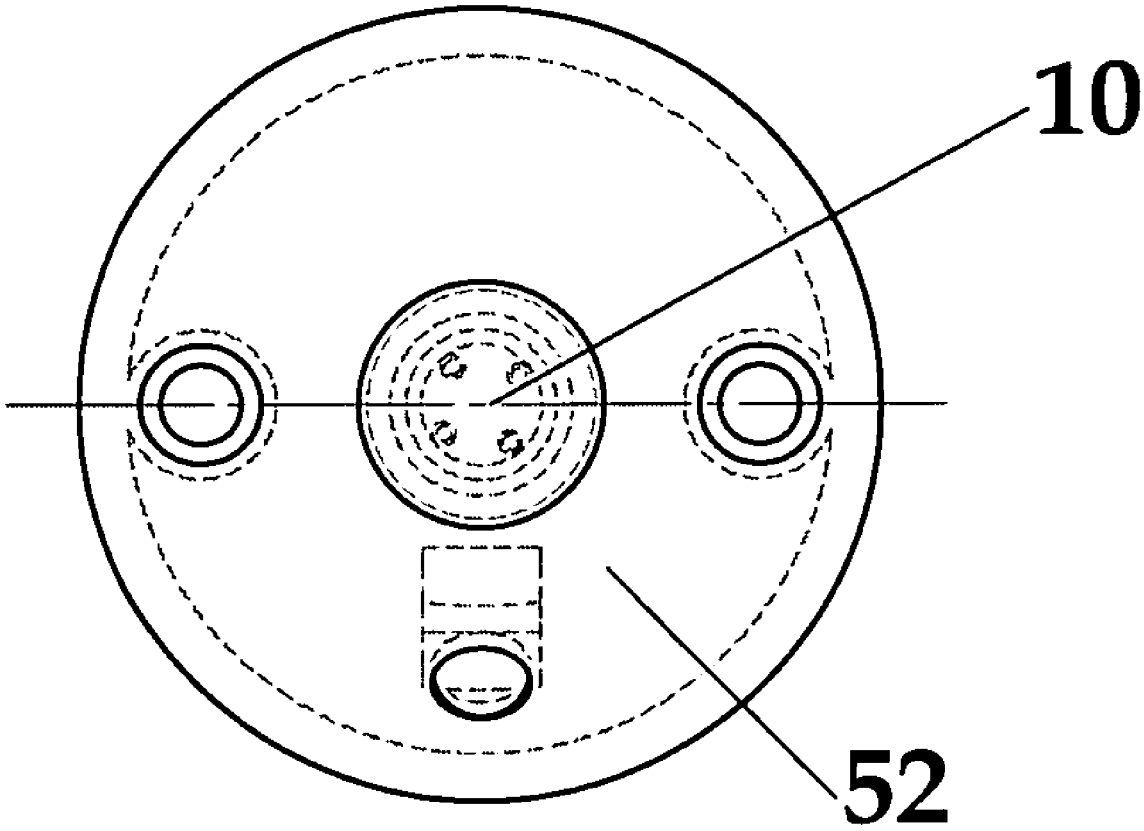
FIG. 6*a* is a pictorial top view of a surface mounted, unitized housing containing several miniature lighting assemblies.
Figure 6B:
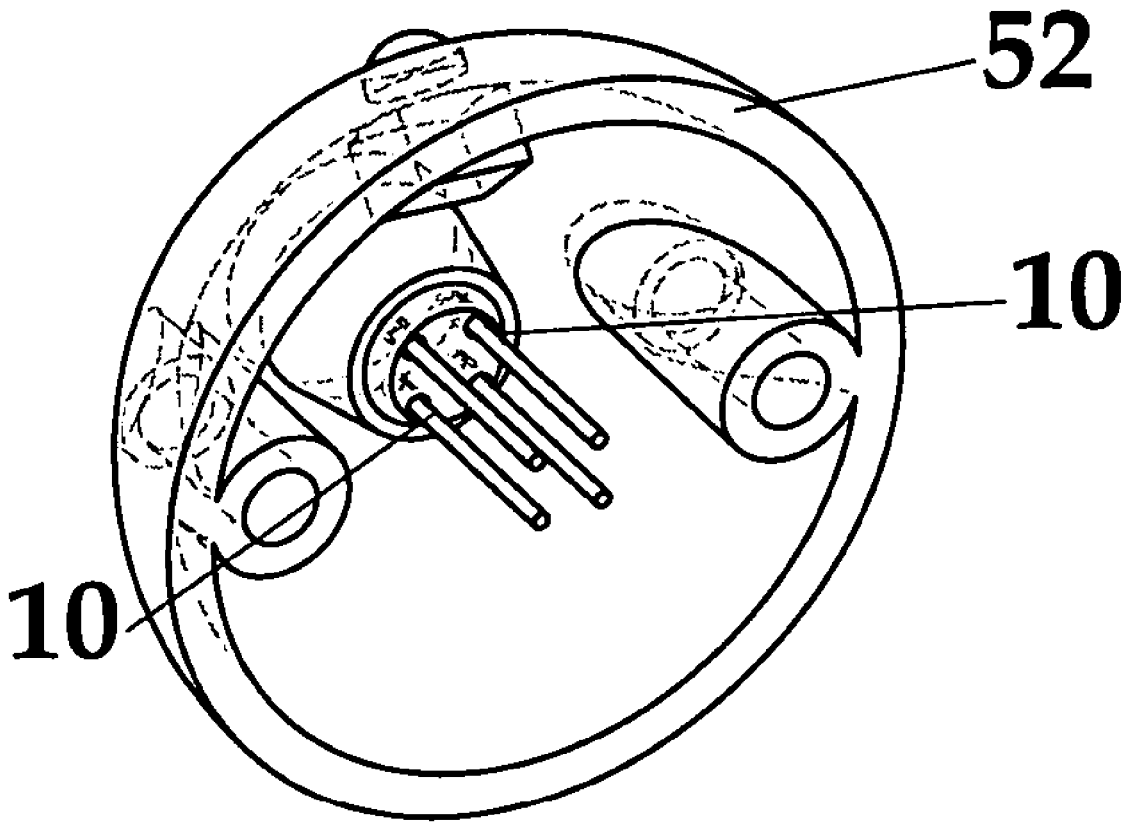
FIG. 6*b* is a pictorial bottom view of a surface mounted, unitized housing containing several miniature lighting assemblies.
Figure 6C:
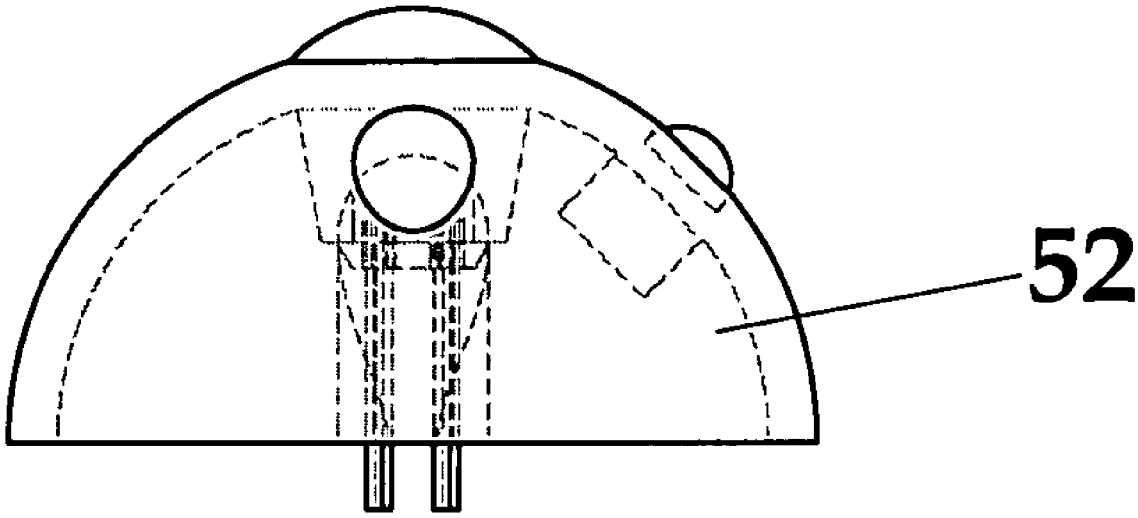
FIG. 6*c* is a pictorial side view of a surface mounted, unitized housing containing several miniature lighting assemblies.

Referring to FIGS. 6*a*–*c*, the miniature light assemblies 10 may also be aggregated to provide a more intense illumination. Several miniature light assemblies 10 may be grouped together within a single, unitized, environmentally sealed housing 52. The unitized housing 52 may be surface mounted or recessed and may also include a switch within the unitized housing 52.

Figure 7A:
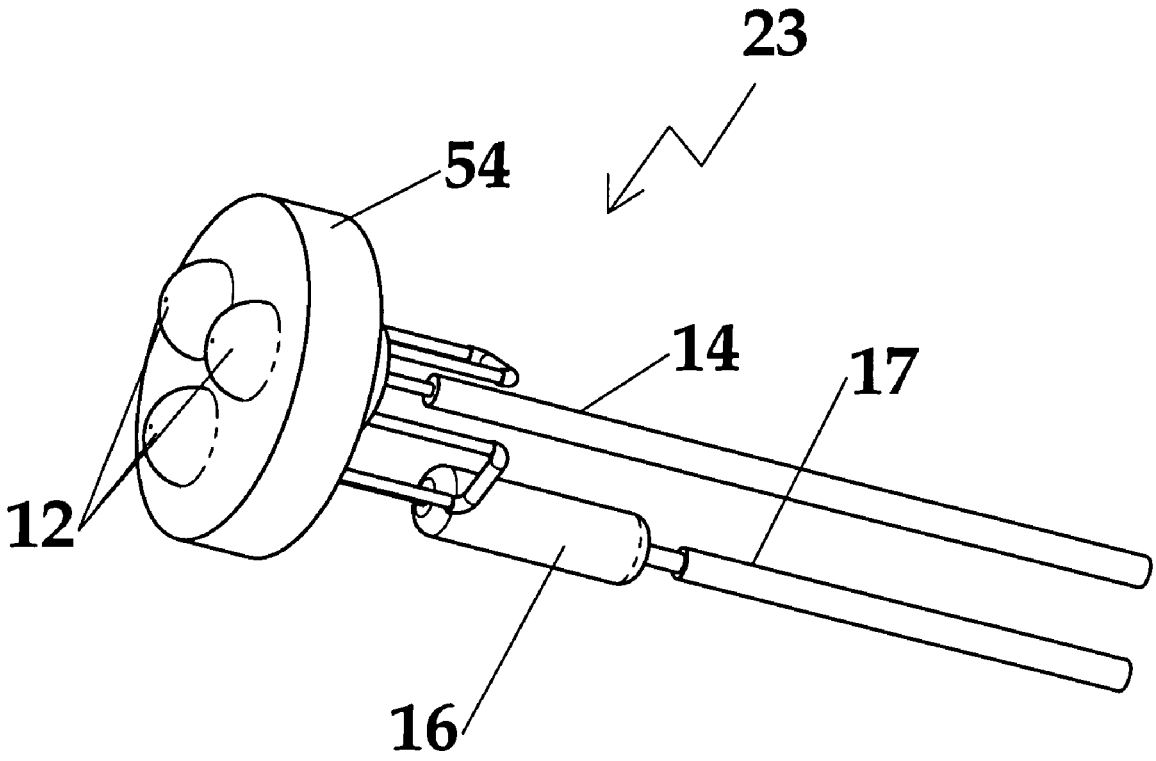
FIG. 7*a* is a pictorial side view of a miniature lighting assembly with several LEDs.
Figure 7B:
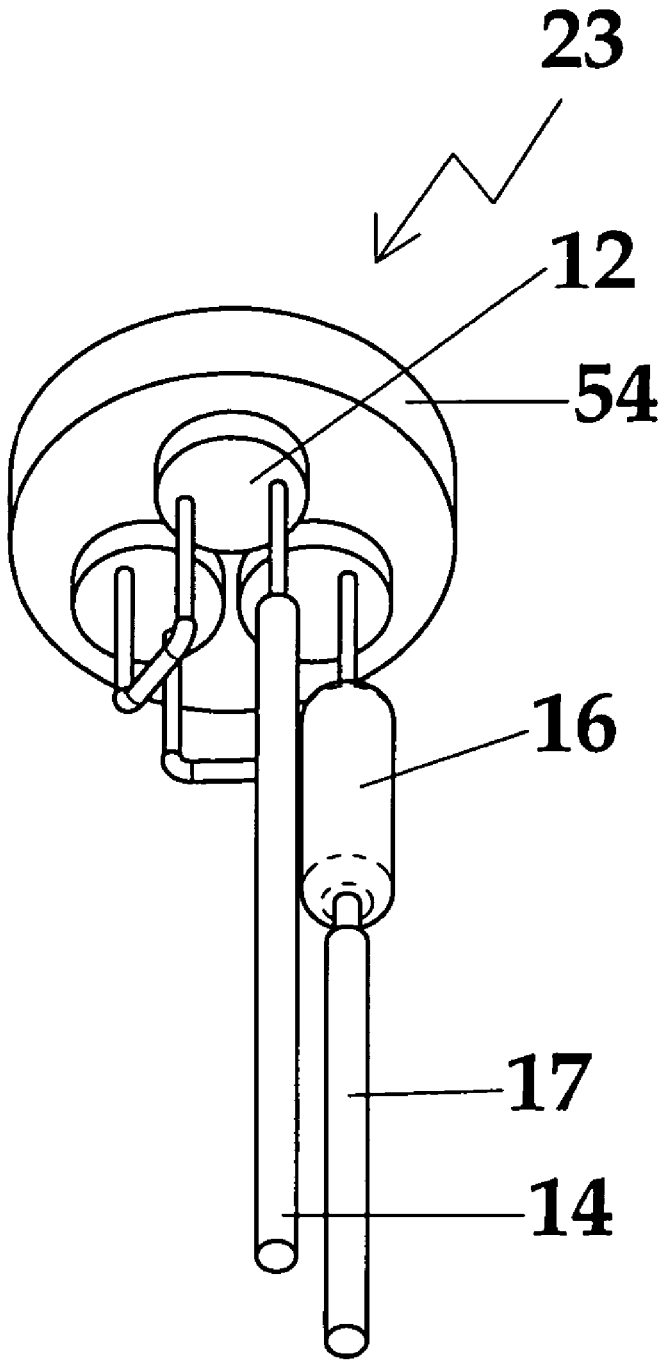
FIG. 7*b* is a pictorial bottom view of the miniature lighting assembly of FIG. 7*a* with several LEDs.
Figure 8A:
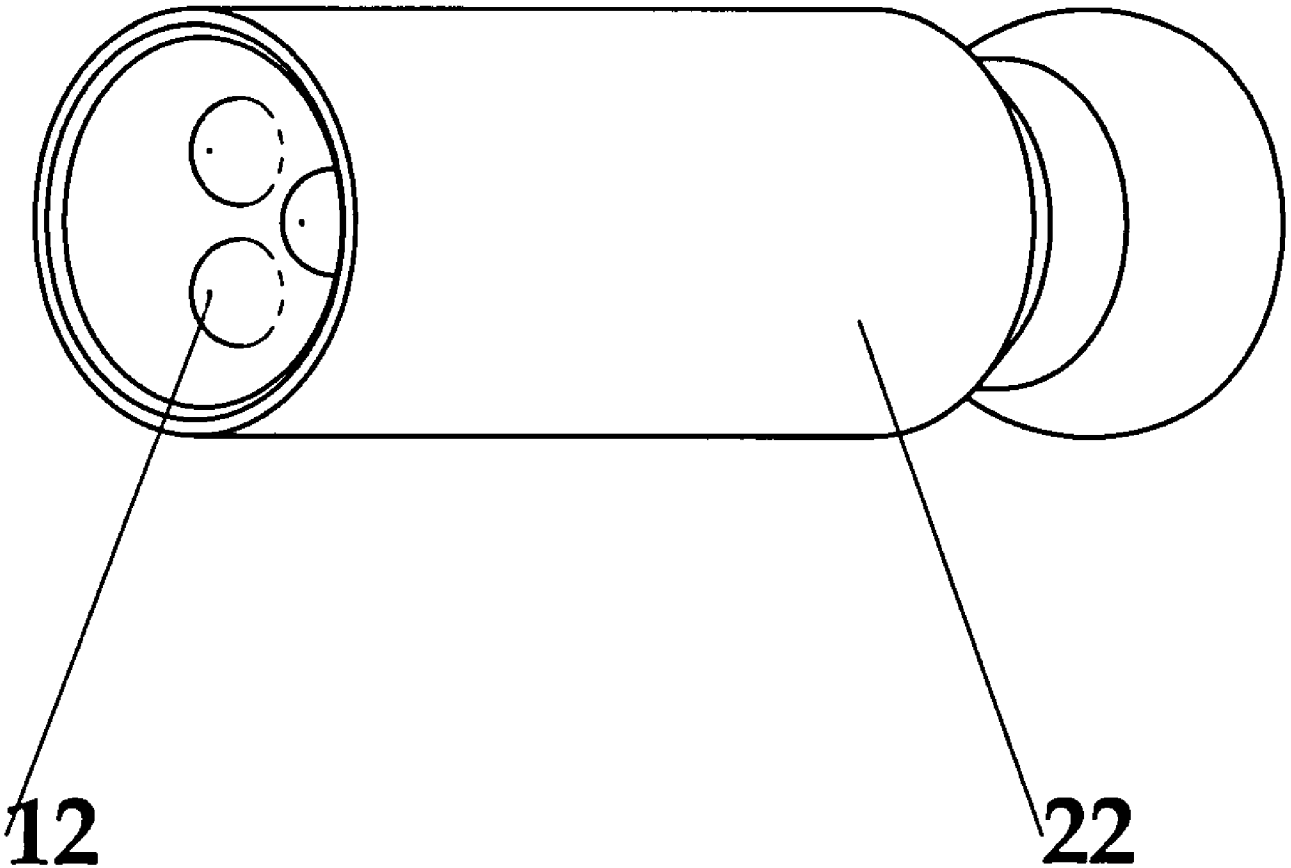
FIGS. 8*a,b,c* are pictorial views of various housings containing a miniature lighting assembly with several LEDs.
Figure 8B:
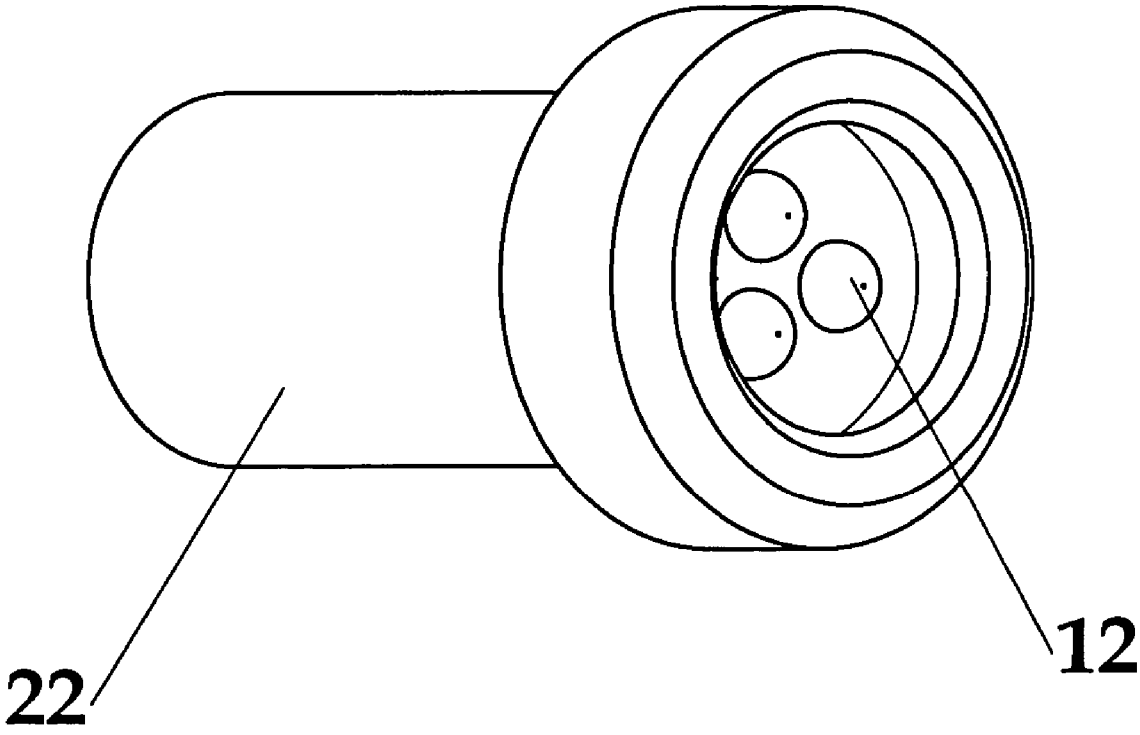
Figure 8C:
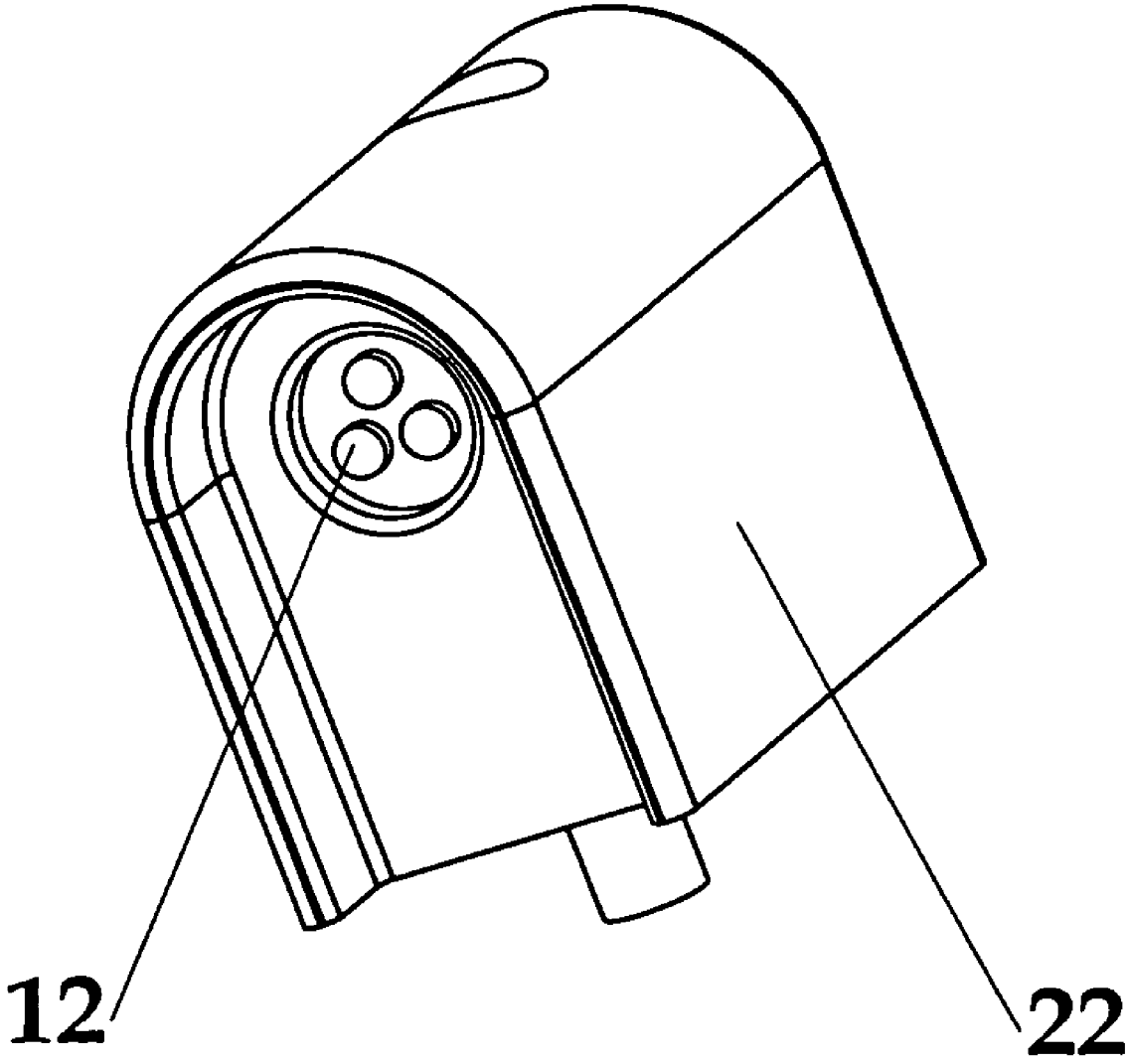

Referring to FIGS. 7*a,b*, another embodiment of the miniature light assembly 10 includes several LEDs 12 grouped together and electrically connected to a negative lead or prong 14, a resistor 16, and a positive lead or prong 17 as previously described in the first embodiment. The LEDs 12 are held in place by a disk mount 54. Referring also to FIGS. 8*a–c*, the electrical component assembly 23 is then pressed into the housing 22, which may have a variety of shapes. Once the assembly 23 is pressed into the housing 22, epoxy is poured into the housing 22 at the bottom portion of the housing 22 in order to permanently seal and unitize the circuitry and LEDs 12 with the housing 22.

Various systems and components of the present invention are now described with reference to FIGS. 9 through 13.

Figure 9:
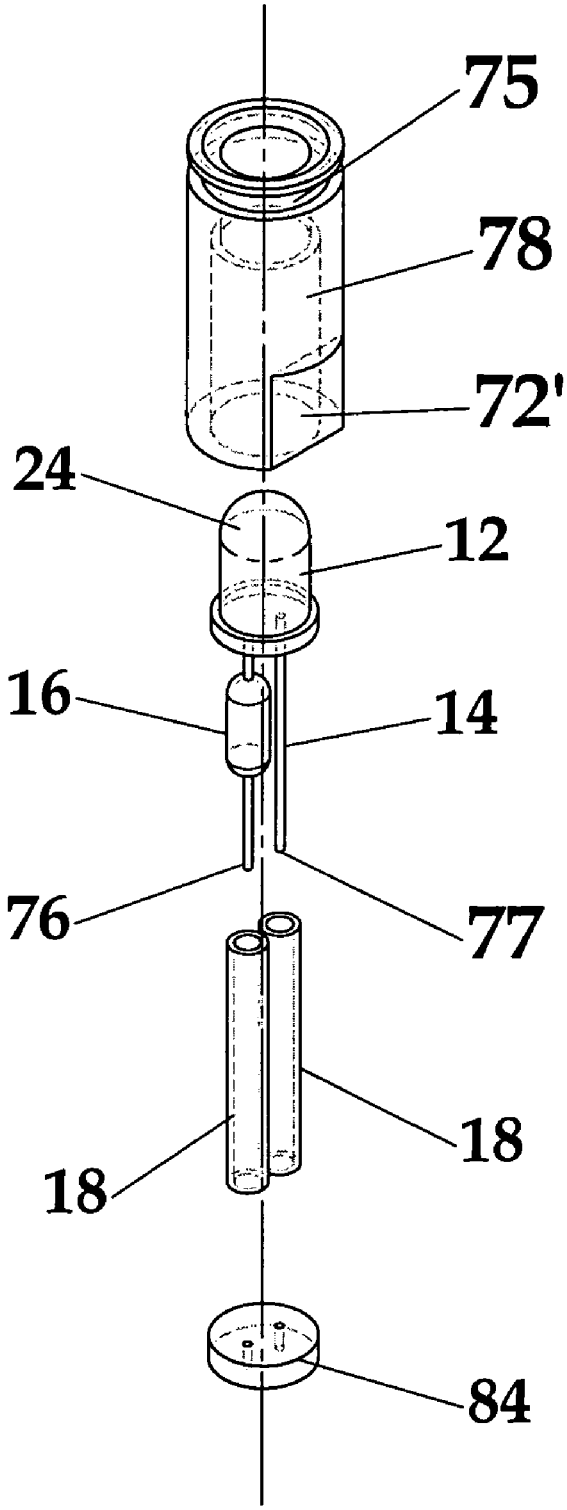
FIG. 9 is an exploded view of a miniature lighting assembly of this invention having two rigid electrical leads.

FIG. 9 presents an exploded view of a miniature light assembly having a light source within a housing 78 and end cap 84. Through the end cap 84 protrude a positive lead or prong 76 and negative lead or prong 77 for supplying power to the light source, which is preferably an LED.

An exploded view of a cross-section of the light bar 80 is shown in FIG. 10 with only one miniature light assembly illustrated for the purpose of simplicity. The lighting bar can be composed of a variety of materials, such as injection moldable or extrudable plastics or polymers, and can be formed in a variety of straight and curved segments.

With reference to FIGS. 10 and 11, a supply line housing bar 62 is attachable to any desired surface, such as the underside of a wooden handrail 79 for deck railings, by means of suitable fasteners 65, inserted into through-holes 64 of a suitable shape and diameter, or alternatively through adhesives. The supply line housing bar 62 has a special recess 63 on a surface that will positioned flush with an opposed surface of cover bar 69, thereby defining a channel within which an electrical supply line 61 will be secured. The electrical supply line 61 may be of the type commercially available and configured with a positive wire 66 and a negative wire 67 covered by a plastic housing 68 that is asymmetrically shaped such that the supply line can be fit into the special recess 63 of the supply line housing bar 62 with only one orientation. That is, the electrical supply line 61 is aligned and oriented according to the shape of recess 63 to ensure the proper positioning of the positive wire 66 and a negative wire 67 within the channel formed between the cover bar 69 and supply line housing bar 62.

The cover bar 69 includes one or more specially shaped recesses 71 capable of receiving the miniature LED light assembly housing(s) 78 in one orientation only, thus ensuring the proper orientation of the positive lead 76 and negative lead 77 of the light source with relative to the positive wire 66 and a negative wire 67 of the supply line 61. The recesses 71 may have flats 72 to perfectly accept a corresponding flat 72' on the LED light housing 78. A recess or relief 73 allows a small flat screwdriver or similar tool to be used to pry out the LED light housing in case replacement is required.

Suitable, commercially available fasteners 70 such as screws, nails or bolts can be inserted into through holes 74 to firmly affix the cover bar 69 to the supply line housing bar 62 and to the desired mounting surface, such as the underside of handrail 79. Proper positioning of the through holes 74 with respect to the housing bar 62 assures no fastener 70 contact or interference with supply line 61.

The preferably opaque LED light housings 78 are shaped in such a way as to be fit and aligned inside the specially shaped recesses 71. The housings may also contain flanges or grooves 75 that can determine the exact depth they can be inserted into the recess 71 in order to assure penetration by the positive lead 76 and negative lead 77 of the light source through the plastic housing 68 and into electrical contact with the corresponding positive wire 66 and a negative wire 67 of the supply line 61. The positive lead 76 and negative lead 77 of the light source consist of rigid prongs having beveled or sharpened tips designed to be of a shape and strong enough to puncture the outer plastic cable covering 68 of the electrical supply cable 61.

With reference to the perspective view provided in FIG. 12, a lighting bar assembly including the near seamlessly mated cover bar 69 and supply line housing bar 62 has been fitted to the underside of a railing top cap 79. The electrical supply line 61 passes through intermediate stanchions 81 or corner posts 82 and can be twisted at point 83 when passing through those posts, however the recess 63 of the supply line housing bar 62 facilitates proper realignment as the supply line 61 is passed to the next light bar segment or to a power supply.

Figure 13C:
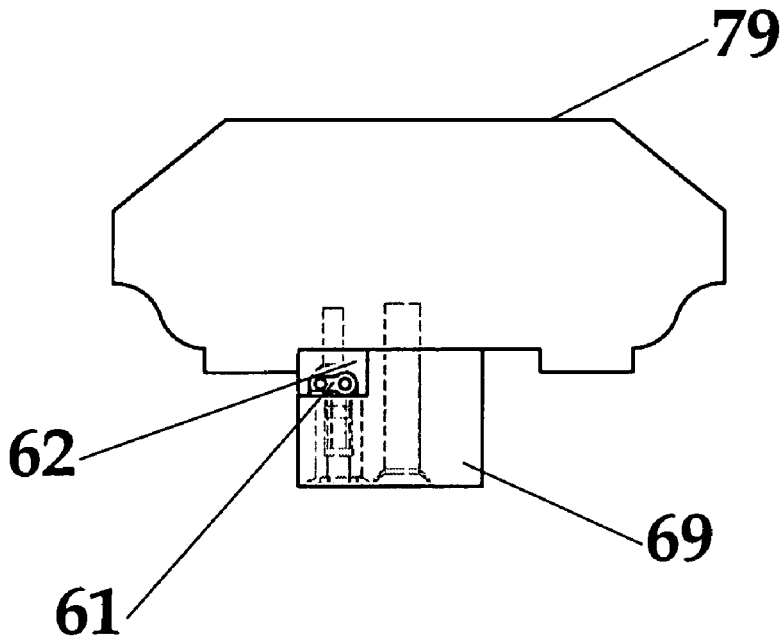
FIGS. 13*a,b,c* are pictorial view of the lighting bar system of the present invention depicting alternative configurations of the line supply housing and cover bar.
Figure 13B:
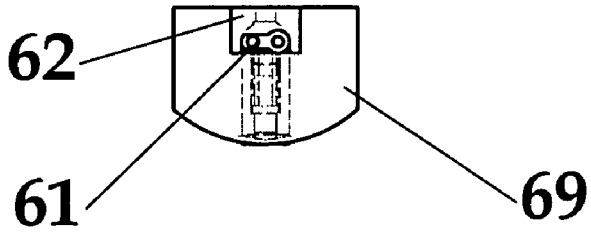
Figure 13A:
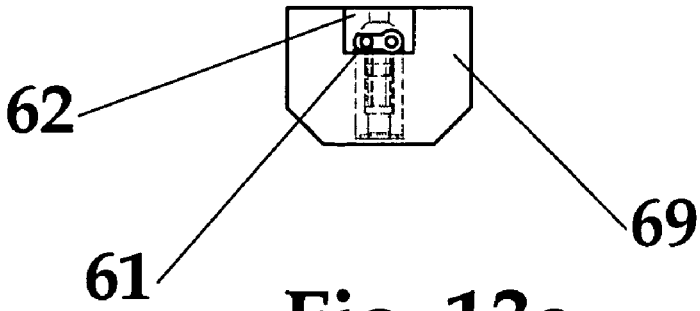

FIGS. 13*a–c* illustrate alternative configurations of the lighting bar assembly. Note that the relative position of the housing bar with respect to the cover bar to which it is mated may be varied, and that the cover bar may have a variety of shapes to match the particular structure to which it is secured. Other aesthetically pleasing and functional variations in the cover bar are deemed to be within the scope of the present invention. It will be obvious to those skilled in the art that multiple lighting bars could be combined to expand the functionality and range of use of the present invention, such as noted above in illuminating all sorts of walkways, landscapes and motor and/or marine vehicle applications.

Although the invention has been described with respect to various embodiments, it should be realized that this invention is also capable of a wide variety of further and other embodiments within the spirit and scope of the appended claims.

I claim:

1. A lighting system, comprising:

a supply line housing having a length, a width, and a supply line recess along the length of the supply line housing dimensioned to receive an electric supply line having a positive lead and a negative lead;

at least one miniature light assembly, each of the at least one miniature light assembly including:

a light source enclosed in a light housing, and a positive prong and a negative prong supplying power thereto protruding from the light housing; and a mounting bar having a length and a width, and including:

a supply line housing recess along the length of the mounting bar dimensioned to receive the supply line housing and to fix the position of the electric supply line, and at least one miniature light assembly recess along the width of the mounting bar for receiving the at least one miniature light assembly, the at least one miniature light assembly recess dimensioned and positioned such that the positive prong and the negative prong of each miniature light assembly disposed in each miniature light assembly recess punctures the electric supply line in order to make electrical contact with the corresponding positive and negative lead.

2. The lighting system of claim 1, wherein the supply line housing and the mounting bar are mated to form a substantially seamless structure.

3. The lighting system of claim 1, wherein a bottom surface of the mounting bar forms an underside of a hand rail.

4. The lighting system of claim 1, wherein the mounting bar and the supply line housing together serve as a hand rail mounting base.

5. The lighting system of claim 4, wherein a portion of the mounting bar is adapted to fit within other railing components.

6. The lighting system of claim 1, wherein the electric supply line is asymmetrically shaped and is mateable with the supply line recess in only one possible orientation.

7. The lighting system of claim 1, wherein the light source is an LED.

8. The lighting system of claim 1, wherein the negative prong comprises an insulated conductor directly connected to the light source;

the positive prong comprises two segments of insulated conductor electrically connected by a resistor, wherein one of the segments is directly connected to the light source; and each miniature light assembly further comprises sealant disposed within the light housing affixing a relative position of the positive prong, the negative prong and the light source, and means for preventing said sealant from exiting the light housing.

9. The lighting system of claim 1, wherein each miniature light assembly further comprises a diffusing lens affixed to the light housing proximate the light source.

10. The lighting system of claim 1, further comprising a power source electrically connected to the electric supply line.

11. The lighting system of claim 10, further comprising means for controlling the power source.

12. The lighting system of claim 11, wherein the power source control means comprises at least one of the group consisting of a photocell, a timer and a switch.

13. The lighting system of claim 1, wherein the mounting bar and the supply line housing are composed of a rigid, structural material.

14. The lighting system of claim 13, wherein the rigid, structural material comprises a polymer.

15. The lighting system of claim 1, further comprising means for orienting the at least one miniature light assembly such that proper polarity between the positive prong, the negative prong and the electric supply line leads is maintained.

16. The lighting system of claim 15, wherein the orientation means comprises a plurality of mated surfaces between each of the at least one miniature light assembly and the corresponding miniature light assembly recess in the mounting bar.

17. The lighting system of claim 1, wherein the mounting bar further includes, near each of the at least one miniature light assembly recess, a feature enabling the prying of the at least one miniature light assembly out from within the at least one miniature light assembly recess in the mounting bar.

18. The lighting system of claim 1, wherein the length of the mounting bar and the supply line housing include one or more curved sections.

19. The lighting system of claim 1, wherein the lengths of the mounting bar and the supply line housing include one or more articulating segments.

20. The lighting system of claim 1, wherein the mounting bar further includes a plurality of through holes along the width of the mounting bar through which the mounting bar is fastenable to a surface.

21. A miniature light, comprising:

an opaque housing having a top portion and a bottom portion, the top portion including an opening and an inside surface;

at least one light source located in the opening of the top portion of the housing for providing illumination to a region external to the housing through the opening;

an electrical component assembly comprising a first insulated conductor having a negative lead connected to the at least one light source, a resistor connected to the at least one light source, and a second insulated conductor having a positive lead connected to the resistor, the electrical component assembly located within the housing;

wherein the first insulated conductor and second insulated conductor each have an end extending out of the housing having sufficient strength and rigidity to puncture an insulating coating of an electric supply line.

22. The miniature light of claim 21, wherein the insulated conductor ends each exhibit one or more sharp features to facilitate puncture of the insulating coating of the electric supply line.

23. The miniature light of claim 21, further comprising:

a sealant surrounding the electrical component assembly within the housing, the sealant affixing the electrical component assembly within the housing; and a means for preventing the sealant from exiting the opening.

24. The miniature light of claim 21, wherein the at least one light source is a light emitting diode.

25. The lighting system of claim 1, wherein the supply line housing further includes a plurality of through holes through the width of the supply line housing through which the supply line housing is fastenable to a surface.

* * * * *